US007472971B2

(12) United States Patent
Schmieder et al.

(10) Patent No.: US 7,472,971 B2
(45) Date of Patent: Jan. 6, 2009

(54) MEDIA CENTER

(75) Inventors: Valerie L Schmieder, Ada, MI (US); Robert J Bockheim, Grand Rapids, MI (US); Christopher A Pike, Grand Rapids, MI (US); Phillip A Jones, Cedar Springs, MI (US); Michael Fedrigo, Comstock Park, MI (US); Robert J Surman, East Grand Rapids, MI (US); Daniel J Bockheim, Wyoming, MI (US)

(73) Assignee: Nucraft Furniture Company, Comstock Park, MI (US)

( * ) Notice: Subject to any disclaimer, the term of this patent is extended or adjusted under 35 U.S.C. 154(b) by 558 days.

(21) Appl. No.: 11/144,967

(22) Filed: Jun. 3, 2005

(65) Prior Publication Data

US 2006/0179458 A1 Aug. 10, 2006

Related U.S. Application Data

(60) Provisional application No. 60/650,846, filed on Feb. 8, 2005.

(51) Int. Cl.
*A47B 81/00* (2006.01)

(52) U.S. Cl. ..... 312/223.3; 312/245

(58) Field of Classification Search ..... 312/317.1, 312/317.2, 318, 223.3, 237, 245, 248, 285, 312/289, 223.6, 351.14; 52/29, 36.1; 108/50.11; 174/58, 375

See application file for complete search history.

(56) References Cited

U.S. PATENT DOCUMENTS 190,586 A * 5/1877 Henrichs ..... 312/199
258,604 A * 5/1882 Richardson ..... 312/200
1,110,399 A * 9/1914 Nunn ..... 312/237
1,900,793 A * 3/1933 Broughton ..... 312/201
3,078,133 A 2/1963 Schauer
3,295,905 A 1/1967 Sisk et al.
3,622,700 A 11/1971 Goetz, Jr.
3,680,936 A 8/1972 Backhaus
3,717,319 A 2/1973 Schultz et al.
3,856,981 A 12/1974 Boundy
3,953,093 A 4/1976 Hero
4,180,298 A * 12/1979 Borgerson, Jr. ..... 312/242
4,313,149 A * 1/1982 Hirose et al. ..... 361/730
4,570,156 A * 2/1986 Nicholas, Jr. ..... 340/547
5,060,425 A 10/1991 Kappers et al.
5,158,344 A 10/1992 Thurston
5,226,705 A 7/1993 Rorke et al.

(Continued)

*Primary Examiner*—James O Hansen
(74) *Attorney, Agent, or Firm*—Van Dyke, Gardner, Linn & Burkhart LLP

(57) ABSTRACT

A media center for housing audio-video equipment and displaying a video display includes a cabinet for housing electronic components, a display panel or column, and an adjustable attachment. The display panel defines a cavity for routing wires of the electronic components. The cabinet is movably attached to the display panel via the adjustable attachment, and is movable relative to the display panel between a use position, where the rear portion of the cabinet is substantially abutted against the display panel, and a service position, where the rear portion of the cabinet is at least partially spaced from the display panel for accessing the wires of the electronic components. The display panel may be supported on a channel member that defines a routing cavity therealong for routing wires of the electronic components.

20 Claims, 14 Drawing Sheets

U.S. PATENT DOCUMENTS 5,536,080 A * 7/1996 Madimenos et al. ..... 312/317.1
5,558,418 A 9/1996 Lambright et al.
5,568,362 A * 10/1996 Hansson ..... 361/736
5,860,714 A * 1/1999 Skord, Jr. ..... 312/242
6,070,956 A 6/2000 Yates
6,241,329 B1 6/2001 Nielsen
6,359,217 B1 3/2002 Thompson et al.
6,588,346 B1 7/2003 Bockheim et al.
6,615,551 B2 9/2003 Chesser et al.
6,755,493 B1 * 6/2004 Krietzman et al. ..... 312/248
6,854,217 B2 2/2005 Bockheim et al.
2004/0045224 A1 3/2004 Chesser et al.

* cited by examiner

MEDIA CENTER

CROSS REFERENCE TO RELATED APPLICATION

The present application claims benefit of U.S. provisional application Ser. No. 60/650,846, filed Feb. 8, 2005, which is hereby incorporated herein by reference in its entirety.

FIELD OF THE INVENTION

The present invention relates generally to cabinets for audio-video equipment and, more particularly, to cabinets for housing and supporting a video screen and audio-video equipment. Aspects of the present invention are suitable for cabinets for residential applications and for commercial applications, such as in a conference room or the like.

BACKGROUND OF THE INVENTION

It is known in the art to provide a cabinet that houses audio-video equipment, such as stereo equipment, DVD players and the like. The cabinet may be positioned at and spaced from a wall of a room, and a television or video screen may be placed on or in the cabinet. The wiring from the components is routed out the rear of the cabinet and between the cabinet and the wall. The wiring thus may be visible or viewable by a person at the cabinet, and may extend from the cabinet upward to a television, where the wiring is readily visible along the wall between the television and the cabinet. Because the wiring is loosely routed out the back of the cabinet and to the respective components or speakers and/or television, the wiring may become tangled or intertwined, which may make changes to the system very difficult and time consuming. Also, in order to change the wiring or equipment, the entire unit may have to be moved out from the wall to get at the wires behind the unit. Such movement of large units is typically very difficult and it may also be difficult to reposition the unit back at the desired location along the wall after the changeover or adjustments are completed.

SUMMARY OF THE INVENTION

The present invention provides a cabinet system or media center that includes a wall portion or panel for supporting or back-dropping a video display and a cabinet or housing portion that houses electronic accessories, such as audio-video equipment and the like. The cabinet may be movably mounted to the display wall portion so that the cabinet may be readily moved away from the display wall portion for accessing wires and cables between the cabinet and the display wall portion, and may be readily moved back to the appropriate location and orientation relative to the display wall portion after the servicing or changeover or adjustment is completed. The movable or adjustable mounting structure or arrangement or element allows the cabinet to be moved from the display wall portion, while the display wall portion stays in the desired position at or near or against the wall of the room, and provides proper indexing or alignment of the cabinet back to the initial position relative to the display wall portion. The media center provides routing of the wires and cables of the electronic accessories or components through the cabinet and display wall portion such that the wires and cables are substantially not viewable to a person at and/or viewing the media center.

According to an aspect of the present invention, a media center for housing audio-video equipment and displaying a video display includes a cabinet or credenza or housing portion for housing at least one electronic component, a display panel or column, and an adjustable attachment mechanism or mount. The display panel comprises a front display wall and opposite side walls that define a cavity for routing wires of the electronic components. The housing portion is movably attached to the display panel via the attachment mechanism. The housing portion is movable relative to the display panel between a use position, where the rear portion of the housing portion is substantially abutted against the display panel, and a service position, where the rear portion of the housing portion is at least partially spaced from the display panel for accessing the wires of the electronic components.

In one form, the attachment mechanism comprises a generally vertical pivot axis, where the housing portion is pivotable about the pivot axis between the use position and the service position. In another form, the attachment mechanism comprises at least one track, where the cabinet portion is movable along the track and generally toward and away from the display panel and between the use and service positions. The display panel and the cabinet are preferably substantially supported on the floor of the room.

According to another aspect of the present invention, a media center for housing audio-video equipment and displaying a video display includes a channel member positioned along a support surface, a cabinet portion at least partially supported by the channel member, and an adjustable mounting structure or attachment that adjustably mounts the cabinet portion relative to the channel member. The cabinet portion supports at least one electronic accessory. The channel member is configured to route wiring of the accessory along the channel member. The cabinet portion is movable via the adjustable mounting structure relative to the channel member between a use position, where the rear portion of the cabinet portion is substantially abutted against or aligned with a portion of the channel member, and a service position, where the rear portion of the cabinet portion is at least partially spaced from the channel member for accessing wires of or associated with the electronic accessory or accessories.

The media center may include a generally vertically oriented panel member or column at least partially supported by the channel member. The cabinet portion may be adjustably mounted to the panel member or column via the adjustable mounting structure. Optionally, the media center may include a generally vertically oriented display panel or column at least partially supported by the channel member and spaced along the channel member from the cabinet and panel member. The display panel may support a display device or video display screen or the like thereat.

Therefore, the present invention provides a media center (such as for residential use in a home or for commercial use, such as in a conference room or the like) that includes a display panel for supporting and/or back-dropping a video display and a cabinet portion that is movably attached to the display panel so that the cabinet portion may be moved away from the display panel for access to wires and cables and the like, and may be readily moved toward and into engagement with the display panel in a proper or appropriate location and orientation relative to the display panel. The cabinet portion is properly indexed relative to the display panel by the adjustable attachment or mounting structure throughout the movement of the cabinet relative to the display panel. The present invention thus provides enhanced access to the rear of the cabinet for wiring, and limits or substantially precludes misalignment of the cabinet relative to the display panel when the cabinet is moved back to the use position. Also, the media center of the present invention is at least substantially supported on the floor or support surface, such that no attachment fasteners or anchors are required to attach or hang the display panel to or from the wall at which it is positioned (although if desired, various fasteners or the like may be used to retain the display panel against or adjacent to the wall when the media center is positioned at the desired location to further stabilize the display panel, without affecting the scope of the present invention). Also, because the display panel provides a cavity that is behind the front display wall and that is substantially encased by the side walls and optionally a rear wall as well, the wiring for the video display (and any other electronic components and/or accessories at or associated with the display panel and/or media center) may be contained within the display panel and will not be viewable by a person at the media center.

The present invention also provides a media center with one or more channel members and/or one or more display panels and/or columns and/or one or more cabinets or housing portions, in various configurations and combinations, depending on the particular appearance and functionality of the media center. The channel member may be positioned along the floor of the room and along a wall of the room, with the columns and display panels supported on the channel member and thus also supported on the floor, and not supported on or by the wall of the room (but may be attached to the wall to limit or substantially preclude tipping away from the wall, without affecting the scope of the present invention). Installation of the media center is thus enhanced, and the columns and display panels may be arranged and located anywhere along the walls of the room without having to align with studs or the like in the walls, such that the media center of the present invention provides enhanced planning flexibility. The columns, display panels and channel member or members facilitate routing of the wires and cables of the various electronic components throughout the media center while concealing the wires and cables from view. The cabinet or cabinets is/are movably mounted to the channel member and/or to the column/panel so that the cabinet/cabinets may be readily pulled out or moved from the channel member/column/panel and pushed back or moved back into the appropriate or desired location at the channel member/column/panel.

These and other objects, advantages, purposes and features of the present invention will become apparent upon review of the following specification in conjunction with the drawings.

DESCRIPTION OF THE PREFERRED EMBODIMENTS

Figure 1:
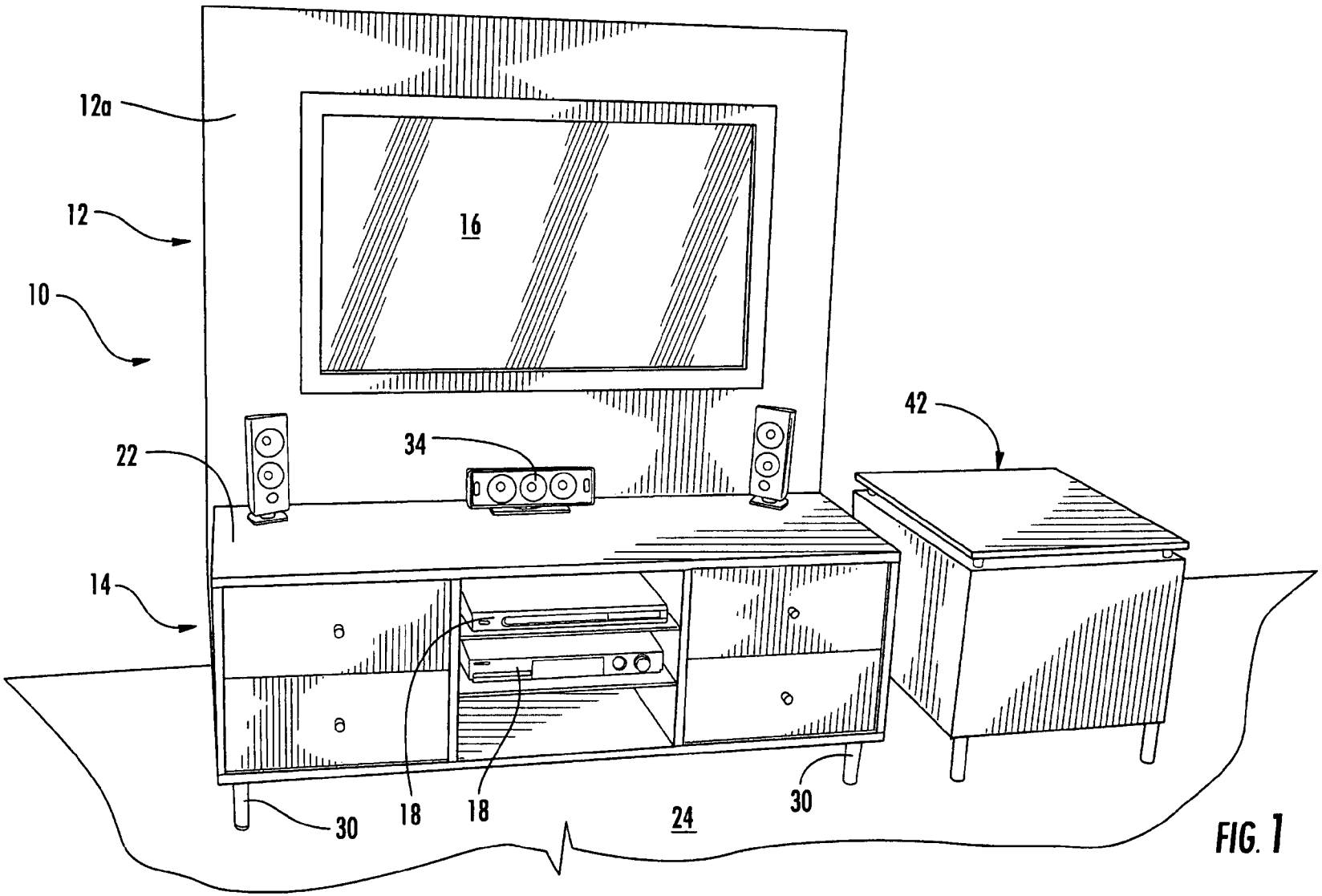
FIG. 1 is a front perspective view of a media center in accordance with the present invention, with the cabinet in a use position.
Figure 2:
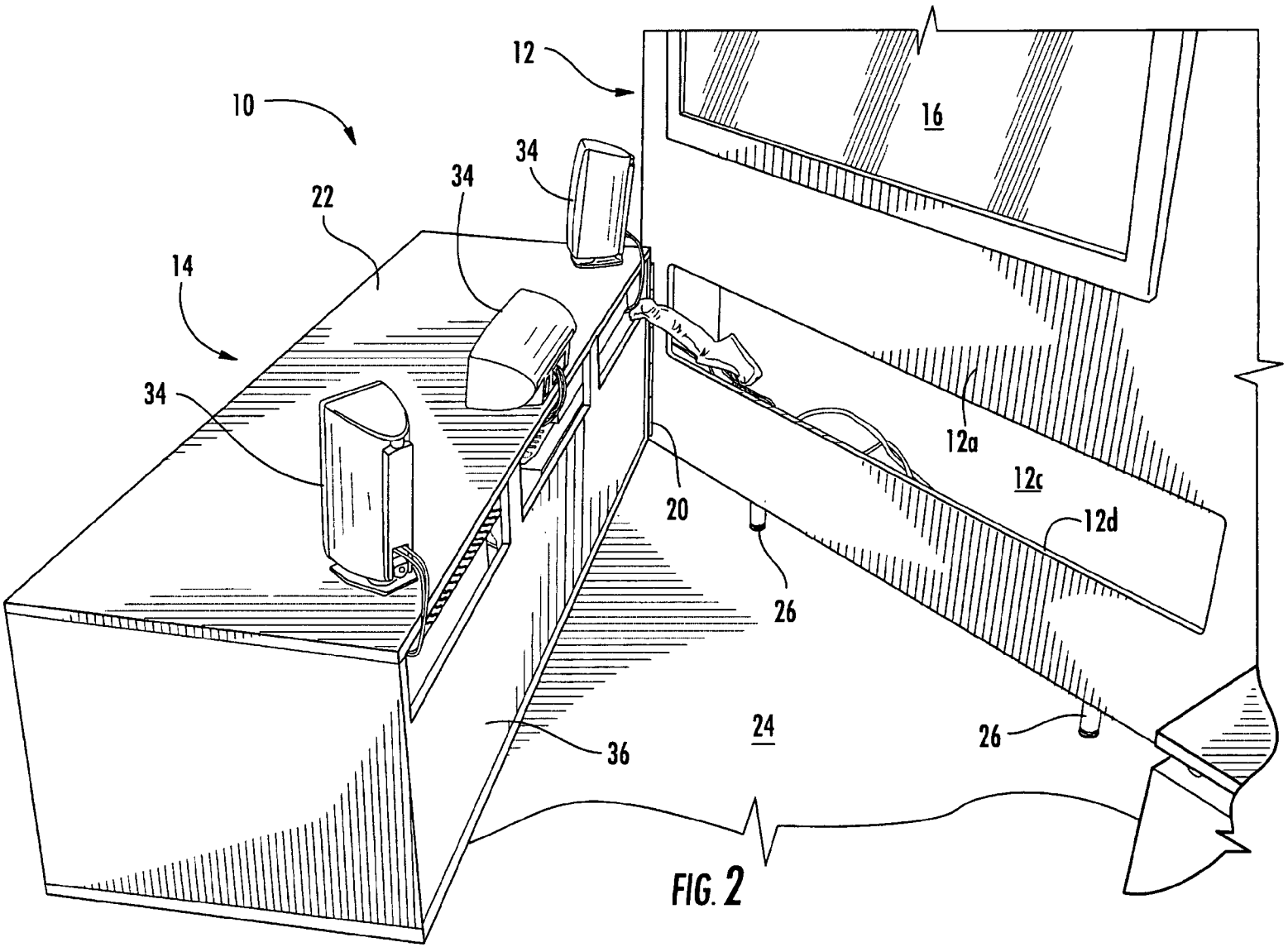
FIG. 2 is a perspective view of the media center of FIG. 1, with the cabinet moved to a service position.
Figure 3:
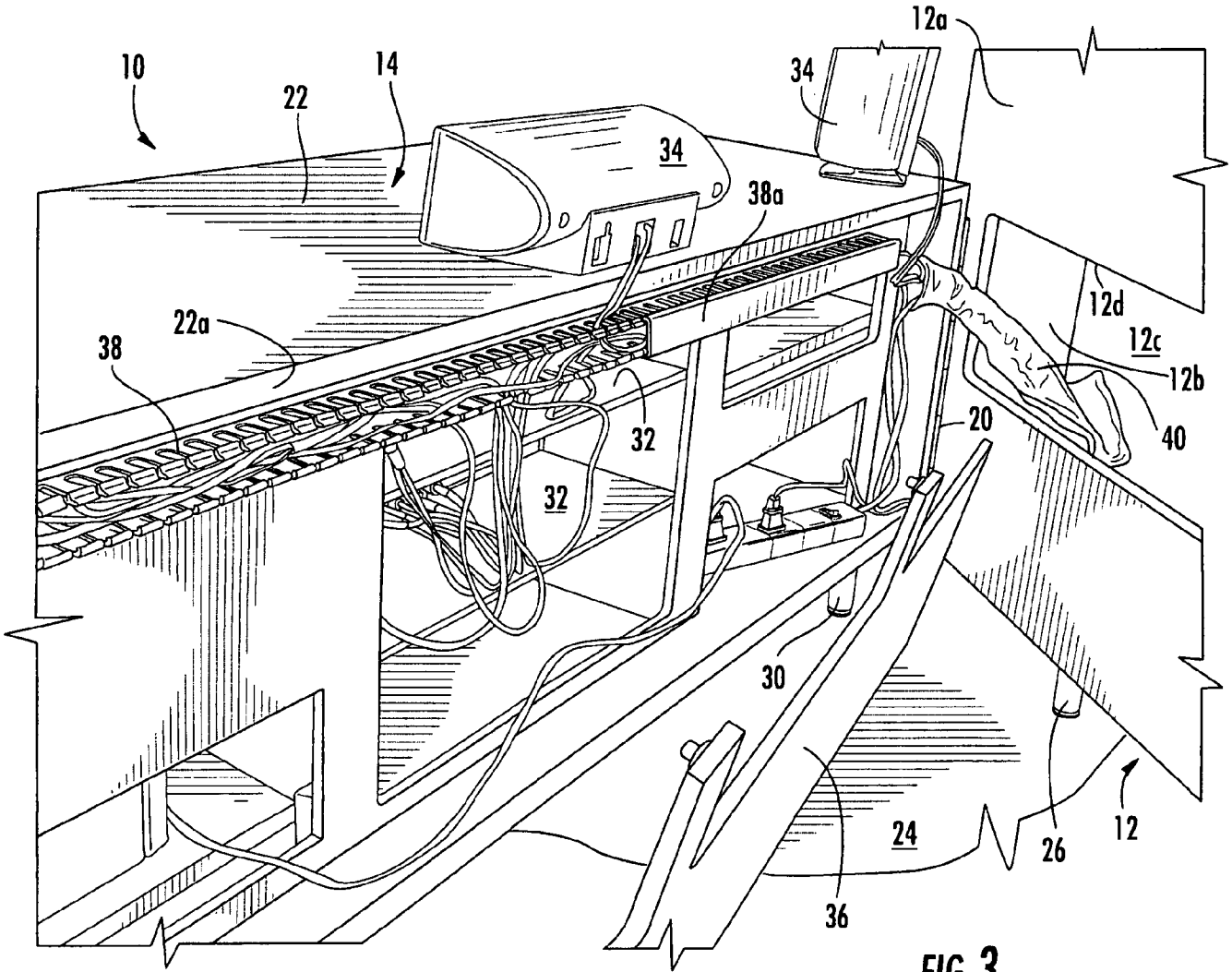
FIG. 3 is a perspective view similar to FIG. 2, with a rear panel removed from the cabinet.

Referring now to the drawings and the illustrative embodiments depicted therein, a media center 10 (such as an entertainment center for holding audio-video equipment in a residential type application) has a display panel or portion 12 and a cabinet or housing portion 14 movably or adjustably attached to the display panel 12 (FIGS. 1-3). Display panel 12 is configured to support or back-drop a video display 16, such as a plasma screen television or a movie screen for a video projection device or the like. Cabinet 14 is configured to support or house or contain audio-video equipment or components (shown generally at 18 in FIG. 1), such as a DVD player, a receiver, an amplifier, a CD player and/or the like. Cabinet 14 movably attached or mounted to display panel 12 via an adjustment or attachment mechanism or structure 20 (FIGS. 2 and 3), such that the cabinet 14 is movable between a use position (FIG. 1), where the cabinet is substantially abutted against a lower portion of the display panel 16, and an access or service position (FIGS. 2 and 3), where the cabinet is at least partially spaced from (yet attached to) the display panel, as discussed below. The video display 16 (such as a plasma screen television or a projection screen or the like) may be mounted or attached to or at an upper portion of the display panel 12 (as shown in FIGS. 1, 2 and 4), or the display may be supported on a support surface 22 of cabinet 14, such that the upper portion of the display panel 12 (the portion that extends above the cabinet so as to be viewable above the cabinet portion) back-drops the video display to provide a finished appearance to the media center, without affecting the scope of the present invention.

Display panel 12 is supported on a floor or support surface 24 of a room, such as via multiple feet or legs 26, and is positionable against a wall of the room (or may be positioned at a corner between two walls if desired to function as a "corner unit"). Display panel 12 comprises a front display wall 12*a* and a pair of opposite side walls 12*b*, which cooperate to define a cavity 12*c* within the display panel. Optionally, the display panel may include a rear wall to substantially contain the wires and/or cables within the cavity defined within the four walls of the display panel. The display panel 12 thus allows the wires and cables of the video display to be routed through the front wall 12*a* and into and along the cavity 12*c* so that they are not viewable at the media center 10. Front display wall 12*a* includes an opening or aperture 12*d* (FIGS. 2 and 3) at a lower region thereof for routing the wires and cables within the cavity 12*c* to the cabinet 14 for connection to the components or accessories housed or located within or on the cabinet 14. The opening 12*d* is at a level that is below the level of a support surface or upper surface 22 of cabinet 14 so as to be substantially not viewable when the cabinet is in the use position).

Preferably, the front display wall 12*a* is substantially thick and/or strong so that it may support a television of the like thereon, such as via suitable mounting brackets attached to the display wall 12*a*. The front or viewable surface of the display wall may be finished to the desired color or appearance so as to provide a finished back-drop to the video display mounted on or positioned at or in front of the display panel. The display panel 12 thus provides a mounting and/or back-drop panel that is substantially supported on the floor or support surface and is thus a substantially free standing display panel (although one or more fasteners or the like may be used to anchor the display panel to the wall at which it is positioned if desired). Optionally, other components and/or accessories or the like may be at or in the display panel, such as lights and/or outlets and/or shelves or the like, depending on the desired appearance and functionality of the display panel and media center, without affecting the scope of the present invention.

Figure 4:
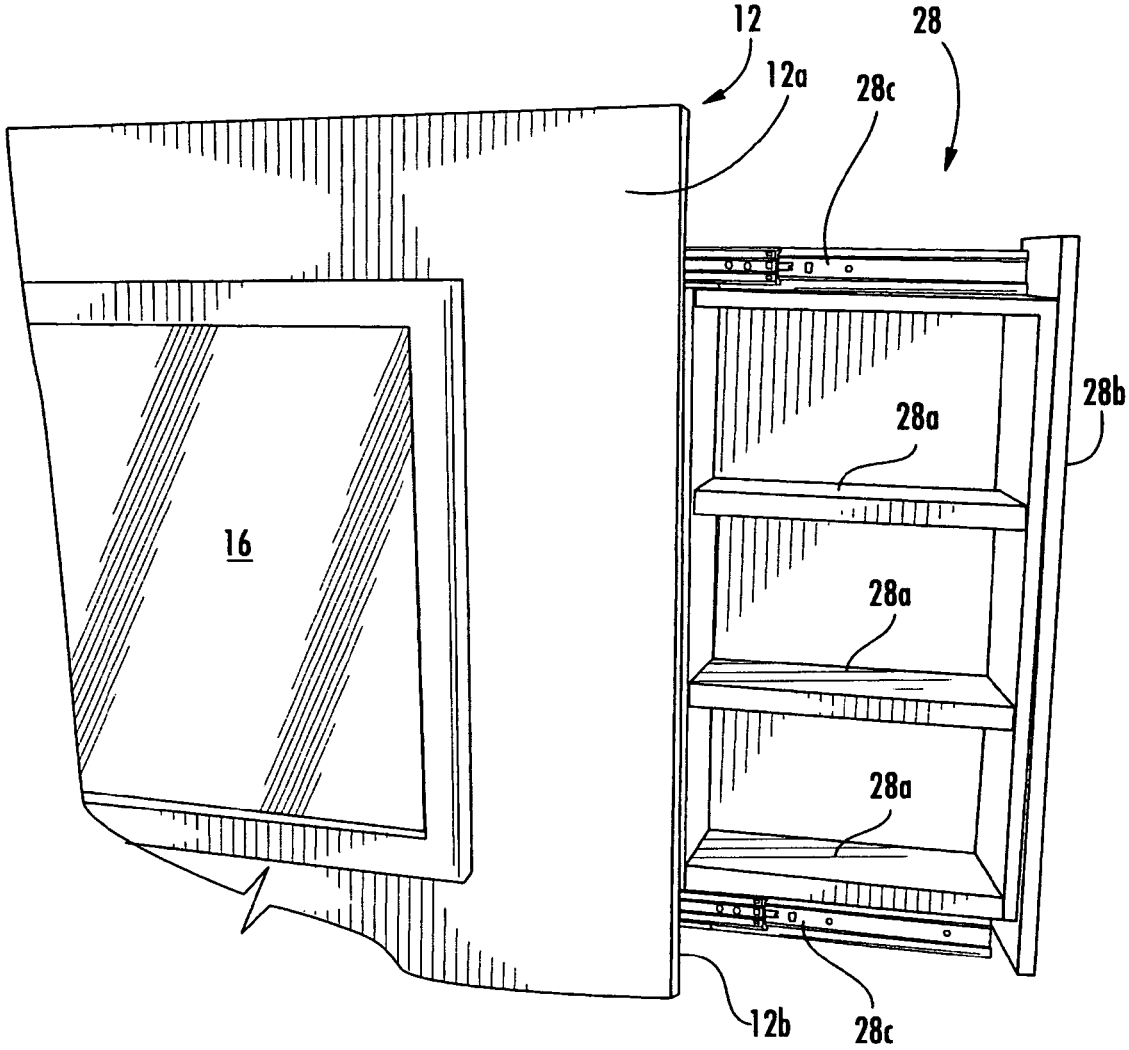
FIG. 4 is a perspective view of a side portion of the display panel, with a support shelf partially extended therefrom.
Figure 5:
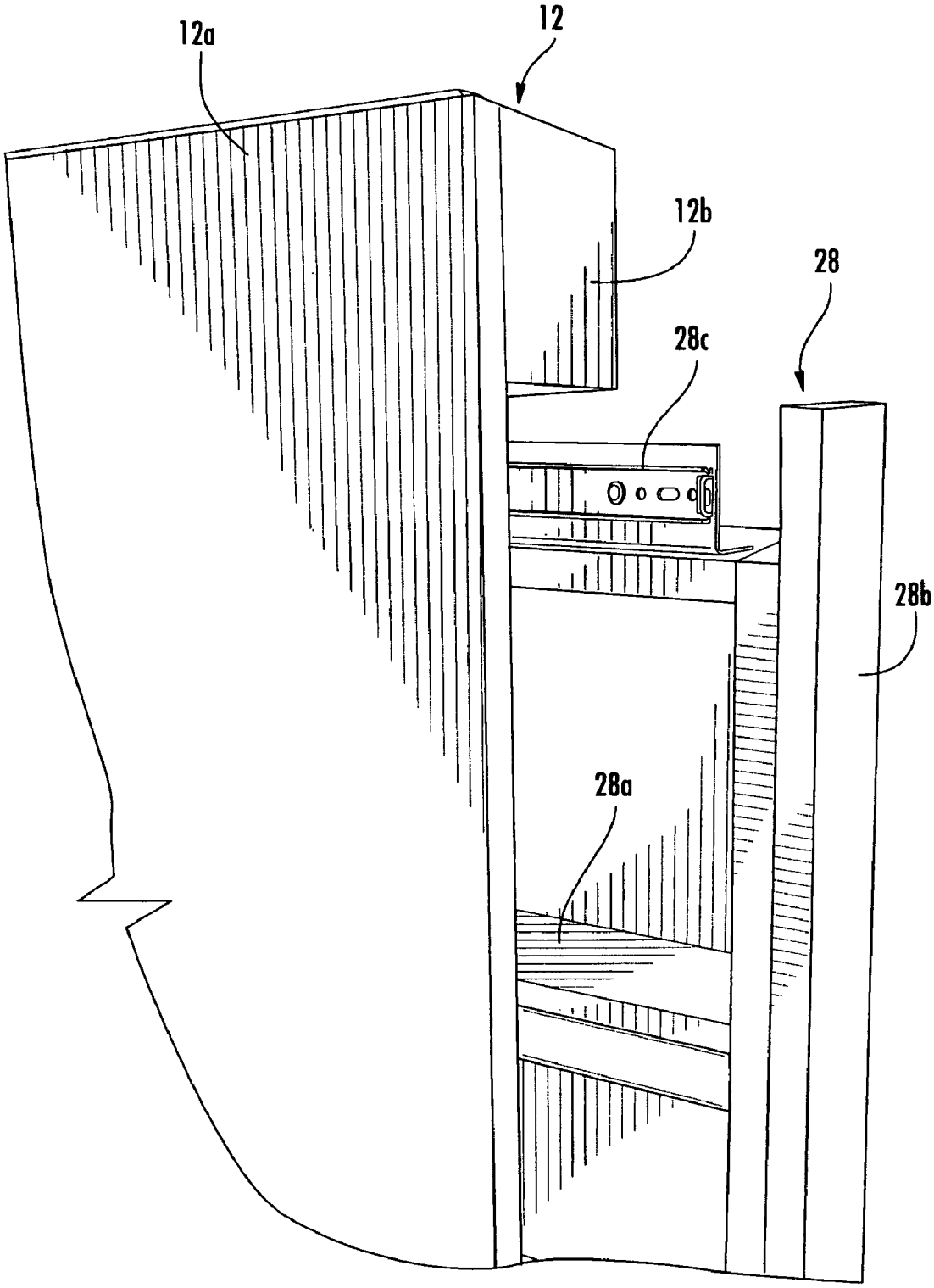
FIG. 5 is a perspective view of the support shelf and display panel of FIG. 4.

As shown in FIGS. 4 and 5, the depth of the display panel 12 (or the width of the side walls 12*b*) is selected to provide sufficient space within the display panel for a sliding or extendable/retractable shelf or drawer or support structure 28, such as for holding videos or the like, such as DVDs, CDs, video tapes and/or the like. The support structure 28 is generally horizontally movable between a retracted position, where the support structure is positioned within the cavity 12*a* of the display panel 12, and an extended position, where the support structure is extended from the side wall 12*b* of the display panel 12 so as to provide access to the items or videos or the like supported on shelves 28*a* of the support structure 28. The support structure 28 preferably includes an outer cover or wall 28*b* that substantially matches and aligns with the side wall 12*b* when the support structure is in the retracted position. Thus, when the support structure is retracted or closed, the support structure is not readily discernible at the side wall of the display panel. As can be seen in FIGS. 4 and 5, the support structure and shelves may be movable along rails or tracks or drawer slides 28*c* or the like between the extended and retracted positions. Although shown and described as a single support structure or shelf at one side of the display panel, the display panel may include one or more support structures or shelves at either or both sides, without affecting the scope of the present invention.

Cabinet 14 is adjustably mounted to display panel 12 and is positionable in the use or closed position so as to at least substantially cover or conceal the aperture or opening 12*d* at the front display wall 12*a*. Cabinet 14 is also substantially supported on the floor or support surface 24, such as via a plurality of legs or feet 30, which may slide over the floor when the cabinet is moved between the use and service positions. As shown in FIGS. 1 and 3, cabinet 14 may include a plurality of shelves 32 for supporting various electronic equipment or components or accessories, such as at an open or non-enclosed area or where a glass door or panel may be at the front, so as to be able to control the accessories via a remote control. The cabinet may also or otherwise include drawers and/or shelves and/or doors and/or other storage areas or means to provide storage for other accessories as desired, and without affecting the scope of the present invention.

Cabinet 14 includes an upper surface or support surface 22, upon which the video display may be set, if desired. Optionally, and as shown in FIG. 1, speakers 34, such as surround sound speakers or the like, may be positioned on the support surface 22. Optionally, the rear edge 22*a* (FIG. 3) of support surface 22 may be notched, such as along a center region of the edge, to allow room for the wires of the speakers (or other electronic components or accessories that may be set on the support surface) to be routed between the notched edge and the front display wall 12*a* of display panel 12 when the cabinet is moved or pivoted to the closed or use position. The rear edge 22*a* may otherwise substantially abut against the front display wall 12*a* (except where notched for the wire passageway) when in the use position to provide a finished appearance to the media center when in the use position or orientation.

Optionally, cabinet 14 may include a rear cover 36, which may be removably attached at the rear of the cabinet to substantially contain and conceal the wires and cables and the like that are within the cabinet and connected to the various equipment/components within the cabinet. As shown in FIG. 2, the rear cover 36 may include openings or apertures through an upper region to allow for passageway of the wires and cables, such as to the speakers or the like at the upper surface 22 of the cabinet 14. The rear cover may substantially contain the wires and cables within the cabinet so that the wires or cables may not move between the cabinet and the display panel and become viewable when the cabinet is moved to the use position. The rear cover 36 may be readily removed from the rear of the cabinet when it is desired to access the wires and components or accessories within the cabinet.

Optionally, and as shown in FIG. 3, cabinet 14 may include a wire routing channel or conduit member 38, along which the wires and cables of the various electronic components and accessories may be routed. In the illustrated embodiment, channel member 38 defines a plastic channel or conduit along an upper region of the cabinet, and includes a cover 38*a* that may be snapped or secured to the channel member after the wires/cables are routed therealong, so as to substantially retain the wires/cables in the channel member.

Optionally, the wires and cables at the cabinet, including wires and cables such as power outlet strip cords and wires and cables for various audio-video equipment or components or accessories at or in the cabinet and at or in the display panel and/or otherwise associated with the media center, may be routed along the channel member 38 and/or may be routed along a cable routing portion or member or sleeve or conduit 40 for routing the wires and/or cables from the cabinet, through the aperture in the front display wall and into the cavity of the display panel. The cable routing sleeve 40 thus may contain the cables and wires together and in an orderly fashion as they extend/traverse between the cabinet and display panel, so that the wires and cables do not become entangled during set up of the media center and during subsequent moving or pivoting of the cabinet relative to the display panel, as discussed below. As shown in FIG. 3, the cable routing sleeve 40 may be located at a side region of the cabinet portion near a pivot axis of the adjustable or movable or pivotable attachment mechanism or structure 20.

As shown in FIGS. 2 and 3, the attachment structure 20 may be mounted at a lower side or corner portion of the front display wall 12*a* of display panel 12 and at a corresponding rearward side or corner of cabinet 14. The attachment structure 20 adjustably joins the cabinet 14 to the display panel 12, so that the cabinet may be moved relative to the display panel (such as to access the wires and/or cables within the cabinet and/or within the cavity of the display panel), yet remains attached and indexed relative to the display panel while it is moved relative to the display panel. Thus, the cabinet may be pulled or moved or pivoted away from the display panel, and may be readily returned to its proper use position and alignment orientation relative to display panel 12 after the set up or servicing or modification or the like is completed.

In the illustrated embodiment, attachment structure 20 comprises a hinge mechanism that pivotally attaches cabinet 14 to display panel 12, such that cabinet 14 is pivotable about a generally vertical pivot axis relative to display panel 12. The cabinet thus may be pivoted or swung open to provide access to substantially the entire back region of the cabinet and the aperture of the display panel to readily access and connect/disconnect and/or route the various wires and cables and cords between the components and/or accessories in or at the cabinet and the display screen and any other accessories in or at the display panel, and the power outlets and cable outlets and the like that may be present at the wall at which the display panel is positioned. By pivoting the cabinet about a generally vertical pivot axis, the cabinet swings substantially open to allow substantial access to the interface between the cabinet and the display panel, and may provide such access regardless of whether the media center is positioned against a wall or at or near a corner of a room. However, the cabinet 14 may be movably or adjustably attached to the display panel via other adjustment means, such as tracks or slides or rails or the like (such as discussed below), so that the cabinet is moved generally translationally outward from the display panel to access the interface area, without affecting the scope of the present invention.

Optionally, the media center 10 may include or may be associated with a separate cabinet or housing 42, which is designed to substantially match the design and appearance of the media center cabinet 14 and display panel 12, but which may be free standing and remote from the display panel and cabinet. The separate cabinet 42 may house a sub-woofer and may include apertures or spaces to allow for sound to emanate unrestricted from the sub-woofer and into the room. The wires of the subwoofer may be routed to (such as along the floor trim or in the wall or the like) and into the display panel 12 and further into the cable routing sleeve to the appropriate component/accessory within the cabinet or media center.

Therefore, the media center of the present invention provides a display panel for supporting and/or back-dropping a video display and a cabinet portion that is movably attached to the display panel so that the cabinet portion may be moved away from the display panel for access to wires and cables and the like, and may be readily moved toward and into engagement with the display panel in a proper or appropriate location and orientation relative to the display panel. Both the display panel and the cabinet are at least substantially supported on the floor or support surface of the room. The cabinet portion may be readily moved or pivoted away from the display panel by sliding the feet or legs of the cabinet over the floor or support surface, and may be readily moved or pivoted back toward the display panel when the servicing is done. Because the cabinet is properly indexed relative to the display panel by the adjustment structure throughout the movement of the cabinet relative to the display panel, the present invention provides enhanced access to the rear of the cabinet for wiring, and limits or substantially precludes misalignment of the cabinet relative to the display panel when the cabinet is moved back to the use position.

Preferably, the display panel and cabinet are both at least substantially supported on the floor or support surface, such that no attachment fasteners or anchors are required to attach or hang the display panel to or from the wall at which it is positioned. The media center of the present invention is thus suitable as a wall unit and as a corner unit as desired and depending on the particular application of the media center. If any attachment to the wall of the room is desired, various fasteners (such as with z-brackets or the like) may optionally be implemented to retain the display panel at or against or adjacent to the wall, so as to further stabilize the display panel and limit tipping of the display panel away from the wall, without affecting the scope of the present invention. The fasteners thus may stabilize the display panel, but may function to support little or no weight of the display panel.

Also, because the display panel provides a cavity that is behind the front display wall and that is substantially encased by the side walls and optionally a rear wall as well, the wiring for the video display (and any other electronic components and/or accessories at or associated with the display panel and/or media center) may be contained within the display panel and will not be viewable by a person at the media center. The display panel thus may be located substantially flush against a wall of a room, with no wires between the rear of the display panel and media center and the wall. Thus, no wires would be visible at the media center, even if one were to look along the wall and behind the display panel.

Figure 6:
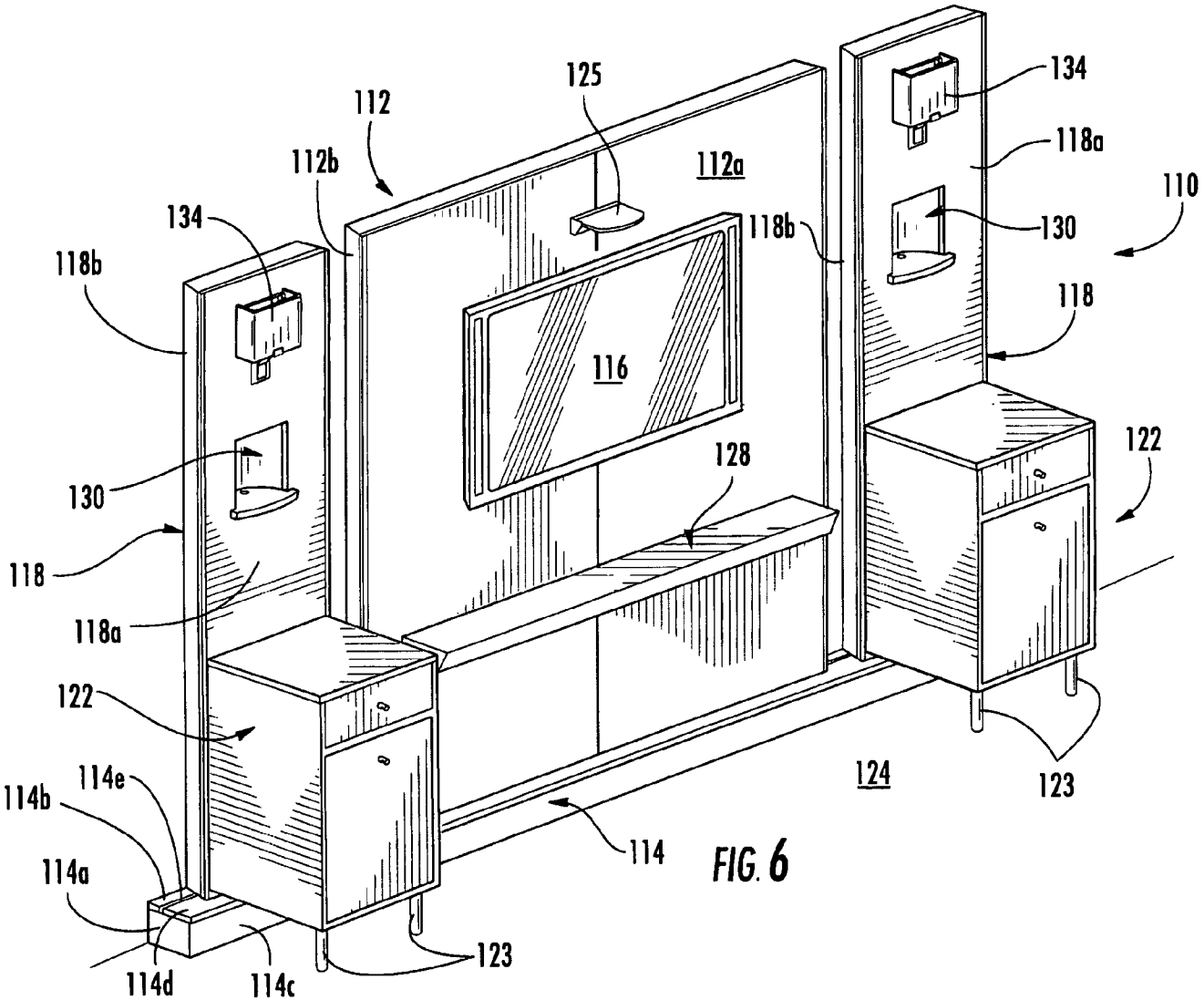
FIG. 6 is a perspective view of another media center in accordance with the present invention.
Figure 7:
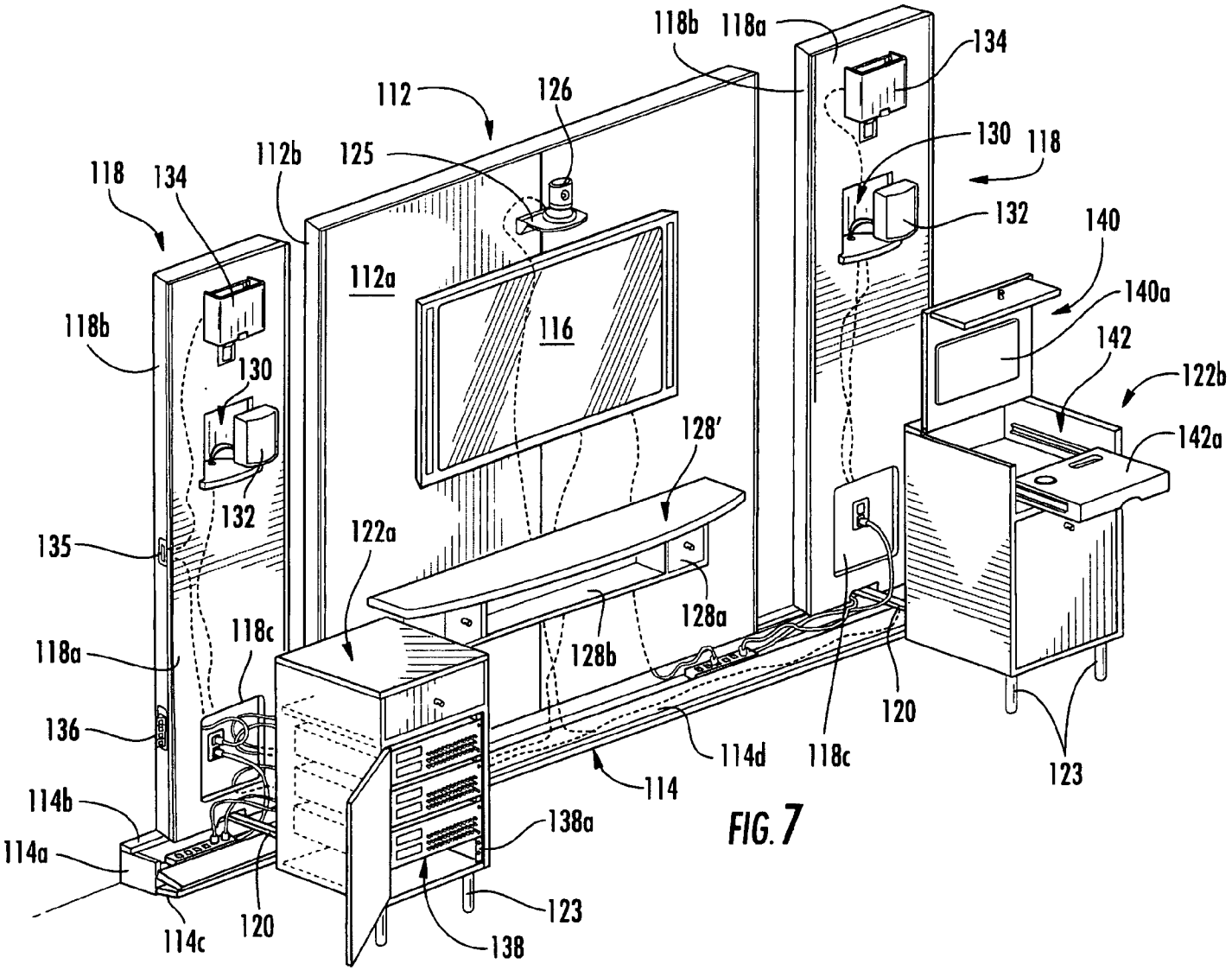
FIG. 7 is a perspective view of the media center of the present invention, showing the wire routing through the display panels and channel member.

Referring now to FIGS. 6 and 7, a media center 110 (such as an entertainment center for holding audio-video equipment and/or presentation equipment/accessories in a residential type application or in an industrial or commercial application) has at least one column or display panel or portion 112 for supporting a video display or screen or board 116 (such as a plasma screen television or a movie screen for a video projection device or the like) that is supported on a channel member or conduit member 114 that extends along the floor or support surface 124 of a room. The channel member 114 defines a cavity or conduit therealong for routing wires and/or cables of electronic accessories/components/equipment at the display panel or otherwise associated with the media center 110. The channel member 114 may be opened along substantially its entire length to access the cavity and route the wires/cables along the channel member 114.

In the illustrated embodiment of FIGS. 6 and 7, the media center 110 includes a pair of columns 118 supported on channel member 114, with one at either side of the center column or display panel 112. One or both columns 118 includes a cabinet or housing portion 122 that is movably or adjustably attached to the respective column 118 or to the channel member 114 via an adjustable mounting structure 120 (FIG. 7). The cabinet portions 122 thus may be readily moved relative to the respective column 118 between a use position, where the rear of the cabinet is substantially abutted against the column (as shown in FIG. 6), and a service or access position, where the cabinet is moved or spaced from the column to allow access to the wires and/or cables at the rear of the cabinet (as shown in FIGS. 7 and 13-15). In the illustrated embodiment, the adjustable mounting structure 120 may comprise a track or rail or slide mechanism that is attached at a lower region of the column 118 and to a lower region or underside of the cabinet 122, such that the cabinet 122 may be moved generally translationally outward/inward relative to the column 118. Such an arrangement may be preferred in certain embodiments where the column may be positioned generally against a wall and at or near a corner of a room, where there may be insufficient room to pivot the cabinet toward the other wall of the room. However, other adjustable mounting structures, such as a hinge mechanism or the like, may be incorporated into the media center to movably mount the cabinets to the columns or channel member, without affecting the scope of the present invention.

The channel member 114 extends a desired length along the floor of the room, with the columns and display panel supported thereon. Although shown as a single channel member spanning the entire width of the media center, two or more shorter channel members may be abutted end to end if desired (with the end panels of the opposed ends being removed or opened to allow routing of the wires and cables from one channel member to the next), without affecting the scope of the present invention. The channel member 114 includes a base portion 114*a* and an upper support portion 114*b*, which function to partially define the cavity or conduit along the channel member and to at least partially support the columns and display panels thereon (although the display panel and/or columns may also be secured to the wall of the room, such as via fasteners or anchors or the like, without affecting the scope of the present invention). The channel member 114 also includes a movable/openable cover that opens or folds down to substantially open the conduit along substantially the entire length of the channel member. As can be seen in FIG. 7, the cover includes a front plate 114*c* that is pivotally attached to a forward end of the base portion 114*a*, and an upper plate 114*d* that is pivotally attached to the front plate 114*c*, such that the plates 114*c*, 114*d* may pivot forwardly to substantially open the channel member to provide substantial access to the wires and cables routed within the channel member.

After routing the wires as desired, the plates 114*c*, 114*d* may be pivoted upward and rearward to substantially close the channel member and contain the wires and cables therewithin. Preferably, and as can be seen in FIG. 6, when the cover is closed, the rear edge of the upper cover plate 114*d* is spaced from the front edge of the upper support portion 114*b* so as to provide a gap or slot 114*e* along the channel member for the wires or cables to pass therethrough when they are routed between the channel member and the columns and/or display panel. The columns and display panel thus may be positioned on and supported on the channel member and any associated wires and cables may be routed through the bottom portions of the columns and display panel and into the channel member, without being visible or viewable to a person at the media center.

Display panel 112 may be similar to display panel 12, discussed above, and is configured to be supported on channel member 114 and to support or back-drop video display 116. Display panel 112 is supported on support portion 114*b* of channel member 114, which is positionable along a floor and against a wall of a room (or may be positioned at a corner between two walls if desired to function as a "corner unit"). Display panel 112 comprises a front display wall 112*a* and a pair of opposite side walls 112*b*, which cooperate to define a cavity within the display panel. Optionally, the display panel may include a rear wall to substantially contain the wires and/or cables within the cavity defined within the four walls of the display panel. The display panel 112 thus allows the wires and cables of the video display to be routed through the cavity so that they are not viewable at the media center 110. As shown in FIG. 7, the wires may be routed within the display panel and out of a lower portion of the display panel and into the conduit of the channel member 114.

As also shown with reference to FIGS. 6 and 7, display panel 112 may support a video screen 116, such as a plasma television screen or the like (or may support other screens or displays, such as a projection screen or the like, or a whiteboard or marker board or smart board or the like), at the front display wall 112*a*, and may include other electronic accessories or components. For example, display panel 112 may include a shelf 125 for supporting a camera or image sensing device 126, such as for video teleconferencing or the like. The wires/cables of the camera and video display may be routed within the display panel and into the channel member 114, where they may be routed to one or more other electronic accessories or components, such as within the cabinet/cabinets 122 or the like.

As also shown in FIGS. 6 and 7, the display panel 112 may support or include a shelf 128, which may provide a generally horizontal shelf or support surface for holding/supporting items at the display panel. Optionally, and as shown in FIG. 7, the shelf 128' may include drawers 128*a* for holding items at the shelf area, such as DVDs, CDs, or remotes for the equipment or components at or in the cabinet/cabinets. The shelf 128' may also include a lower shelf 128*b* for holding or supporting items. The shelf or shelves may support various user-accessible items or equipment or components, such as a DVD player or VCR or the like, if desired. Optionally, the lower shelf and/or drawers may be recessed within the display panel 112 to provide additional support area on the shelf or within the drawers, without extending further out from the display panel.

Similar to display panel 112, each column 118 may include a front wall or face 118*a* and opposite side walls 118*b* (and optionally a rear wall) that define a cavity within the column for routing wires and/or cables for one or more electronic accessories or components or the like positioned at or in the column 118. For example, the column 118 may include a shelf area or alcove 130, which may be recessed partially within the column, for holding a speaker 132 or the like, and/or the column may include a light or lamp or illumination source 134. The wires from the speaker and/or light may be routed from the shelf area (such as through a hole or aperture in the shelf, which may include a rubber grommet for guiding and holding the wires at the hole or aperture) and/or light, respectively, within the column and to a lower end or portion of the column. In the illustrated embodiment, the wires from the light source 134 may be connected to a switch 135 so that a user may activate/deactivate the light source at the column (the switch may be at the side wall of the column as shown, or may be elsewhere on or at or in the media center, without affecting the scope of the present invention).

As shown in FIG. 7, columns 118 may also include other electrical accessories or components, such as an outlet strip 136 along one of the side walls 118*b* so that it is readily accessible at the side of the media center (or elsewhere as desired). The outlet strip 136 may include one or more power outlets, and may include other communication jacks or ports, such as one or more voice or data jacks or ports. The wires or cables of the outlet strip 136 may be routed through the column 118 to the appropriate destination, such as to a power outlet and/or to a data or communication source or device, which may be at the wall of the room or in or at the media center, such as in or at the display panel 112 and/or the channel member 114 and/or one of the cabinets 122.

The wires/cables of the media center thus may be routed from the column into the channel member 114 (via the slot 114*e*), and/or may be routed out of an opening 118*c* (FIG. 7) in the front face 118*a* of the column and into an opening (not shown in FIGS. 6 and 7) at the rear of the respective cabinet 122, depending on the end destination/source of the wires/cables. The opening in the column may generally align with or correspond with or couple with the opening in the cabinet (when the cabinet is moved to substantially abut the column) to provide enhanced wire management of the accessories or devices or components of the media center, while the adjustable mounting structure or track or rail allows for access to the back of the components in the cabinet and allows for enhanced connections and wire management of the accessories or devices or components of the media center. For example, a wire or cable may be routed along the channel member and into the column (such as through the slot 114*e* and through an opening in the bottom of the column) and then into the cabinet (via the respective openings in the column and the cabinet) to connect to an accessory in the cabinet. Optionally, a wire or cable may be routed from an opening or slot of the channel member and into the cabinet, such as through an opening at the rear or bottom of the cabinet. The channel member also provides for enhanced wire management of the wires/cables between accessories or devices or components located at different or separated cabinets and/or columns or the like of the media center, while allowing for access to the wires/cables along the channel member.

Figure 14:
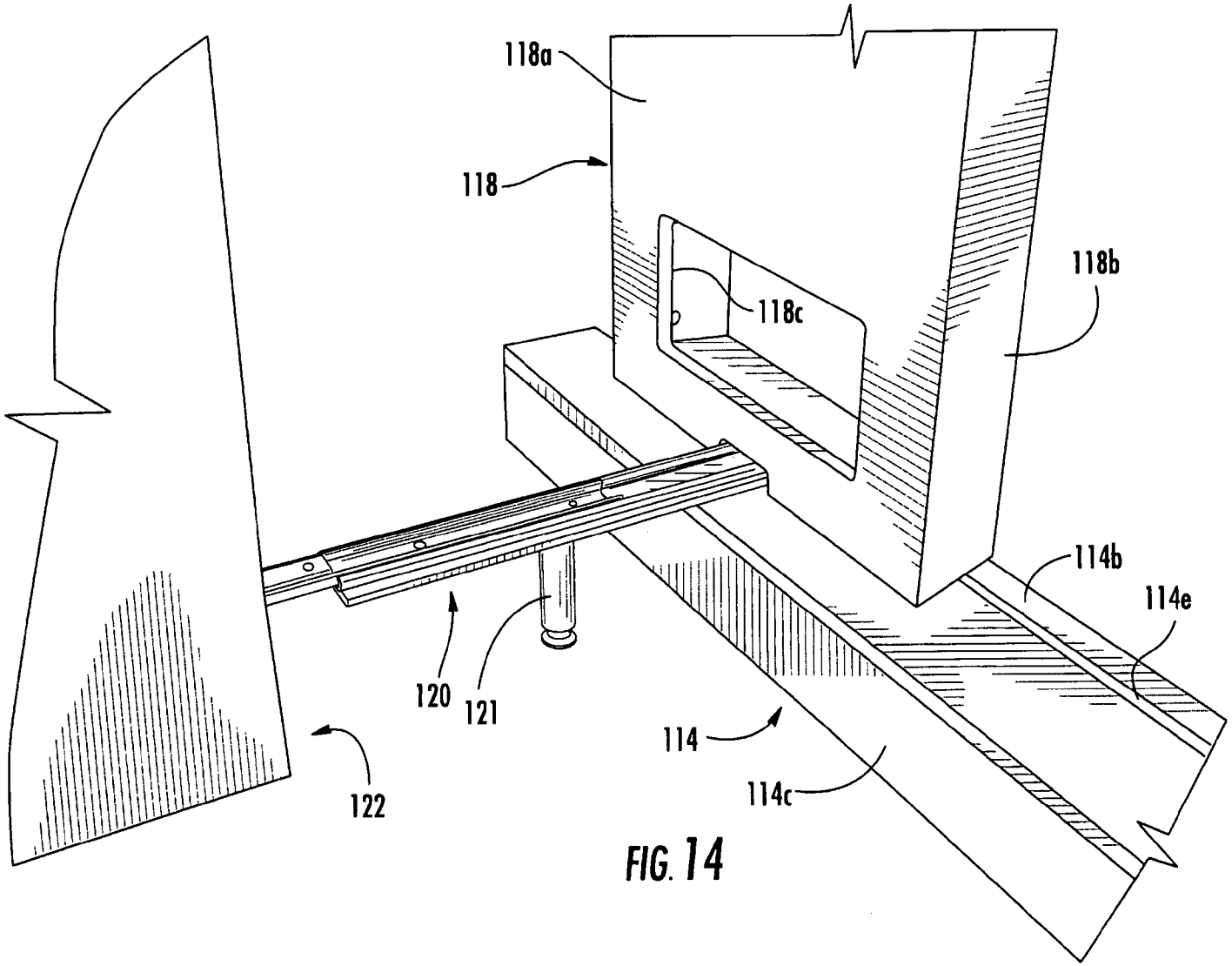
FIG. 14 is a perspective view of the adjustment mechanism of the media center of FIG. 13.
Figure 15:
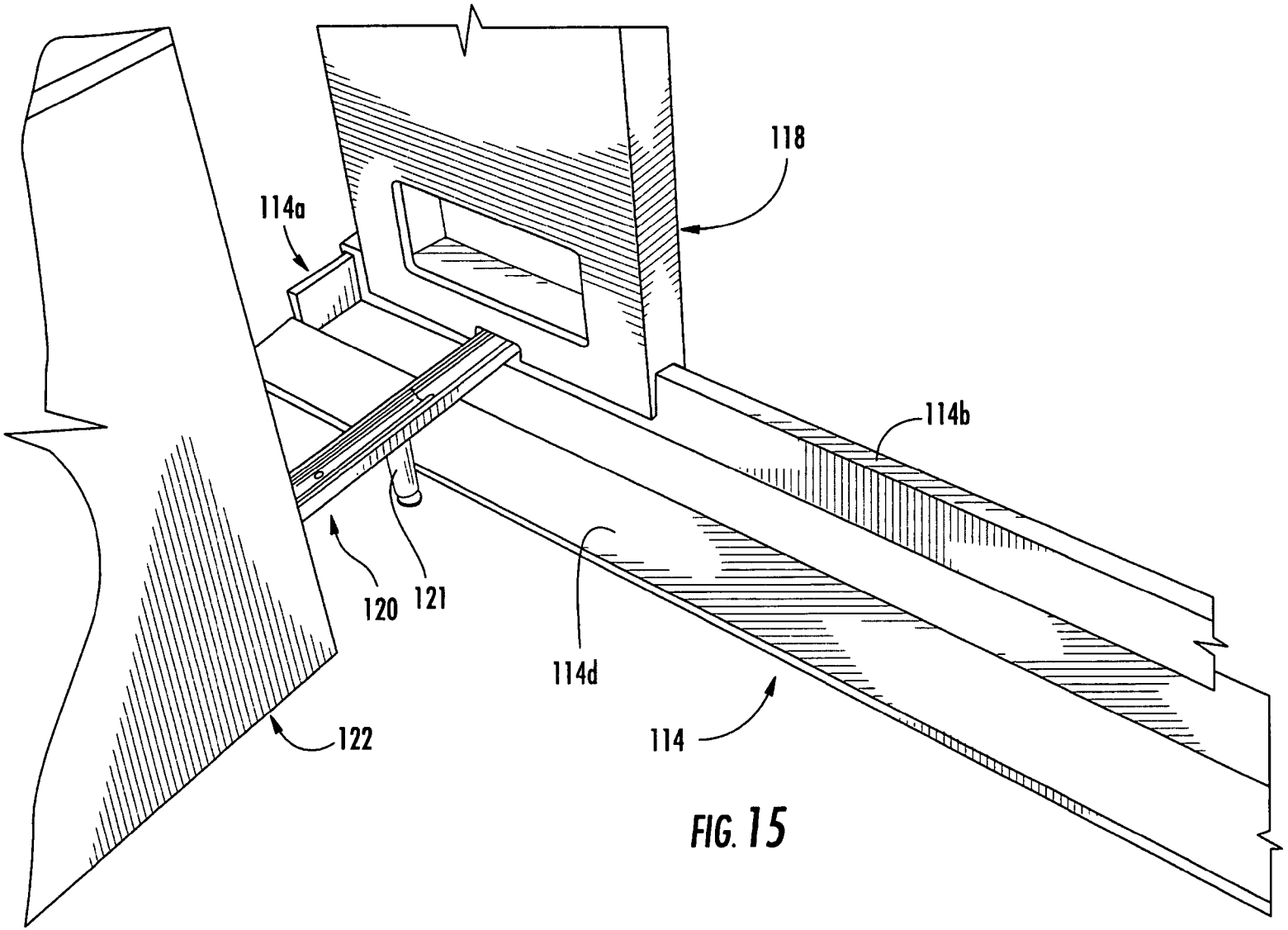
FIG. 15 is another perspective view of the adjustment mechanism of FIG. 14.

Cabinets 122 are movably mounted to the respective columns 118 and/or channel member 114 via the adjustable mounting mechanism 120, as discussed above. The cabinets may store or house various electronic components or accessories or the like (such as various multimedia electronic equipment, such as DVD players, video devices, mixers, processors, amplifiers, equalizers and/or the like), and the wires from the electronic components or accessories may be routed out of a rear portion of the cabinets and through the opening 118*c* and into the respective column 118. The cabinets 122 may be readily moved from the respective columns 118 and channel member 114 so that the wires and cables and cords and the like are readily accessible at the interface of and between the column and the cabinet, as shown in FIG. 7. As can be seen with reference to FIGS. 6, 7 and 13-15, the cabinets may be supported by the column and/or channel member and/or mounting mechanism 120 and by a plurality of feet or legs 123. As shown in FIGS. 14 and 15, the mounting mechanism 120 may also include a foot or leg or support 121 to provide support of the cabinet and mounting mechanism at or near the channel member if desired. The forward feet or legs 123 of the cabinets may slide along the floor or support surface as the cabinets are moved relative to the respective columns and the channel member and between the use and access positions.

In the illustrated embodiment of FIGS. 6 and 7, one of the cabinets 122*a* may house or contain electronic accessories 138, such as various audio-video components or the like (such as on shelves or the like in a cabinet portion), and the cabinet may include a drawer or the like for holding other items. The cabinets may include shelves or drawers or slide-out shelves or the like for holding or supporting the components or accessories, or (and as shown in FIG. 7) the components 138 may comprise racking units that are attached to brackets or racking attachments 138*a* within the cabinet 122*a* to substantially fixedly, yet removably, retain the racking units to the cabinet. Optionally, however, the cabinet 122*a* may include shelves for supporting standard audio-video equipment or accessories, without affecting the scope of the present invention. The racking units 138 may be readily inserted into the racking attachments 138*a* of the cabinet, whereby the electrical connections to the corresponding wiring may be made as the racking units are inserted into the racking attachments.

The racking units 138 may comprise typical racking units having a front panel and controls and a mounting plate at the front panel for connecting or securing the racking unit to the respective brackets, such as via fasteners or the like. The racking units may comprise electrical circuitry and connectors, which may not be contained within a casing or housing, and which may readily connect to corresponding connectors or wires of the cabinet. For example, the racking units may include plugs or connectors or wires that readily connect to the corresponding connectors or wires of the cabinet as the racking units are inserted into the cabinet, such that additional wiring connections and cables or cords or the like are not required. The connectors of the cabinet may connect the racking units (such as via the wiring routed within the cabinet and out the rear portion of the cabinet) to appropriate outputs or controls or circuitry at or in the column and/or channel member to achieve the desired connections and operations/functions of the racking units.

In the illustrated embodiment, the other cabinet 122*b* includes a presenter's platform or pedestal for a presenter to stand at during a presentation at the media center 110. The pedestal may include a flip-up top 140 that may be raised upward to expose or uncover a computer station or presenter's station 142, which may include a pull-out shelf 142*a* that may support a laptop or computer keyboard or the like for the person to use in making their presentation. The flip-up top 140 may include a marker board 140*a* or the like for a user/presenter to use during the presentation and when the top is raised as shown in FIG. 7. The computer station 142 may also include a data or communication port or the like and an outlet or outlets for the laptop to plug into if necessary or desired. The data port and any output or communication or data wires may be wired to the appropriate accessories or components of or at or associated with the media center so that the presenter may control the desired accessory, such as a projector or video display or the like, via the laptop or keyboard (or other control device) at the pedestal. The cabinet 122*b* may also house a computer or CPU below the presenter's station and/or may house one or more accessories or components within the cabinet portion, if desired.

The media center 110 thus may be positioned against or adjacent to or near a wall of a room and may provide a video display screen or device, such as for a presentation within a conference room or the like. The media center may include various electronic components or accessories or equipment, such as in cabinets and/or in columns and/or display panels, with the wiring and cables and the like of the components being routed within the cabinets/columns/display panels and along and within the channel member, such that the wires and cables are substantially contained and concealed or hidden from view, in order to provide an organized and aesthetically pleasing wiring system for the accessories and the like. The channel member and/or the columns and/or the cabinets and/or the display panel may include one or more outlet strips or outlets to provide electrical power to the appropriate respective accessories. As shown in FIG. 7, the media center may be positioned at a wall of a room such that one or both of the columns (or the display panel) may be generally aligned with a power outlet at the wall, so that the outlet strips of the media center may be plugged into the wall outlet to supply power to the media center. However, the media center may be set up in other configurations and positions, with a power cord routing from a wall outlet into the channel member or into the display panel, without affecting the scope of the present invention.

Figure 8:
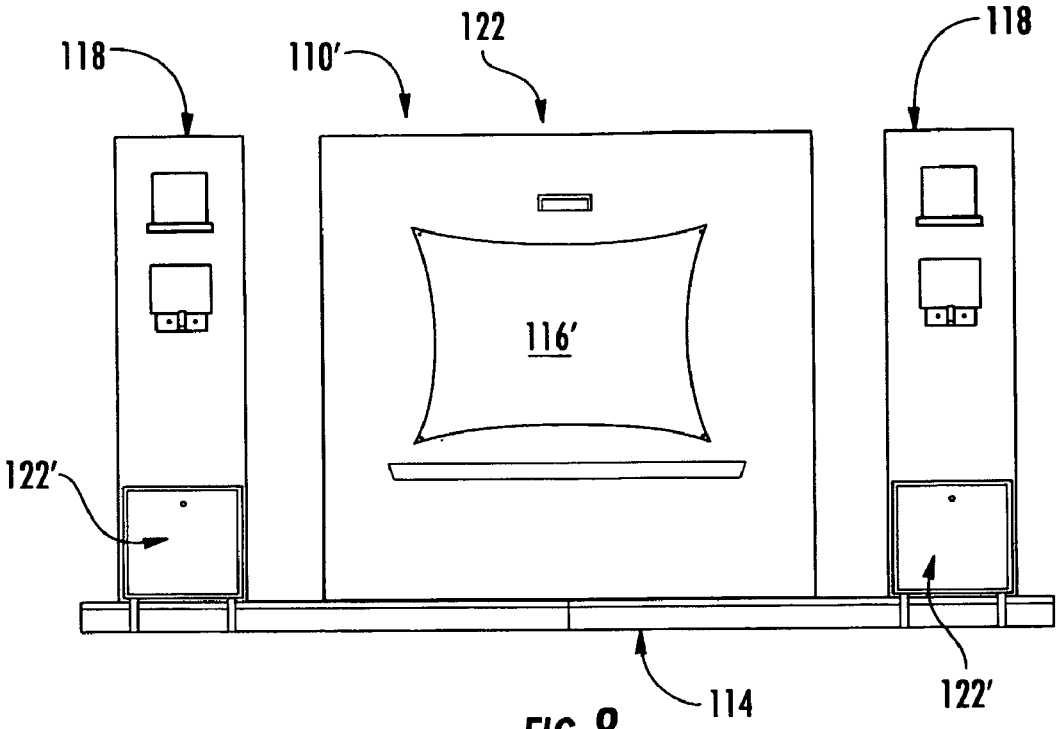
FIG. 8 is a front elevation of another media center of the present invention.

Optionally, the media center of the present invention may include other types of columns and/or display panels and/or cabinets, and may include different combinations of columns and display panels and cabinets at or on the channel member, depending on the particular application and desired function and/or appearance of the media center. For example, a media center 110' (FIG. 8) may include a center display panel 112, a channel member or members 114, and a pair of opposite columns 118 and cabinets or housing portions 122'. The cabinets 122' may house or contain various electronic accessories or components, and may be movably or slidably mounted to the columns, such as in a similar manner as described above, such that a detailed discussion of the columns, cabinets and channel members will not be repeated herein. In the illustrated embodiment, the display panel supports a display screen 116', such as for a projector (such as a projector at a conference table in the conference room) to project a video or image onto the screen for viewing by the conferees. The display screen 116' may be a generally rectangular screen mounted to the display panel or may comprise a scalloped screen (or other decorative design) as shown in FIG. 8 to enhance the appearance of the media center.

Figure 9:
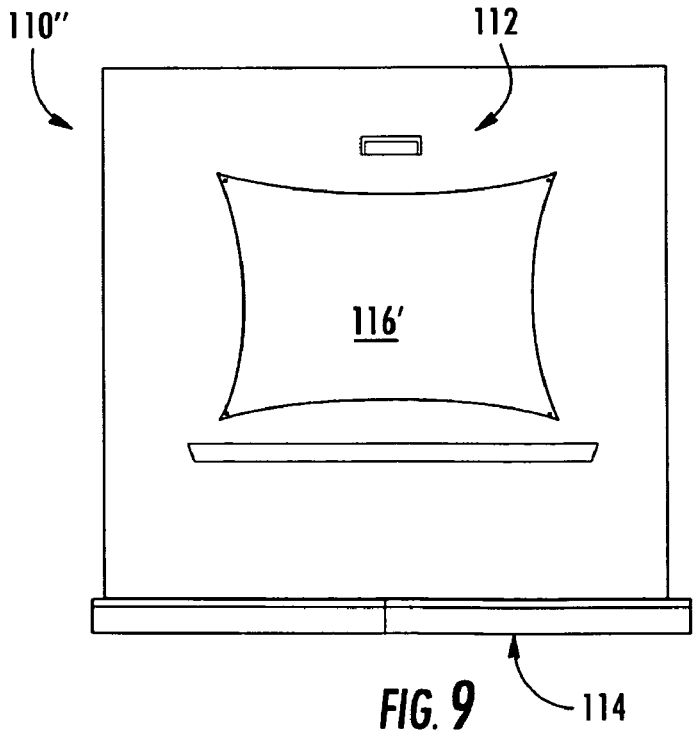
FIG. 9 is a front elevation of another media center of the present invention, with a single display panel.

Optionally, the media center 110" (FIG. 9) may include a channel member 114 and a display panel 112, without columns or cabinets or the like, depending on the desired functionality and appearance of the media center. The display panel 112 may support a display screen 116' (as shown in FIG. 9) or may support other video display units or projector screens or the like, depending on the particular application.

Figure 10:
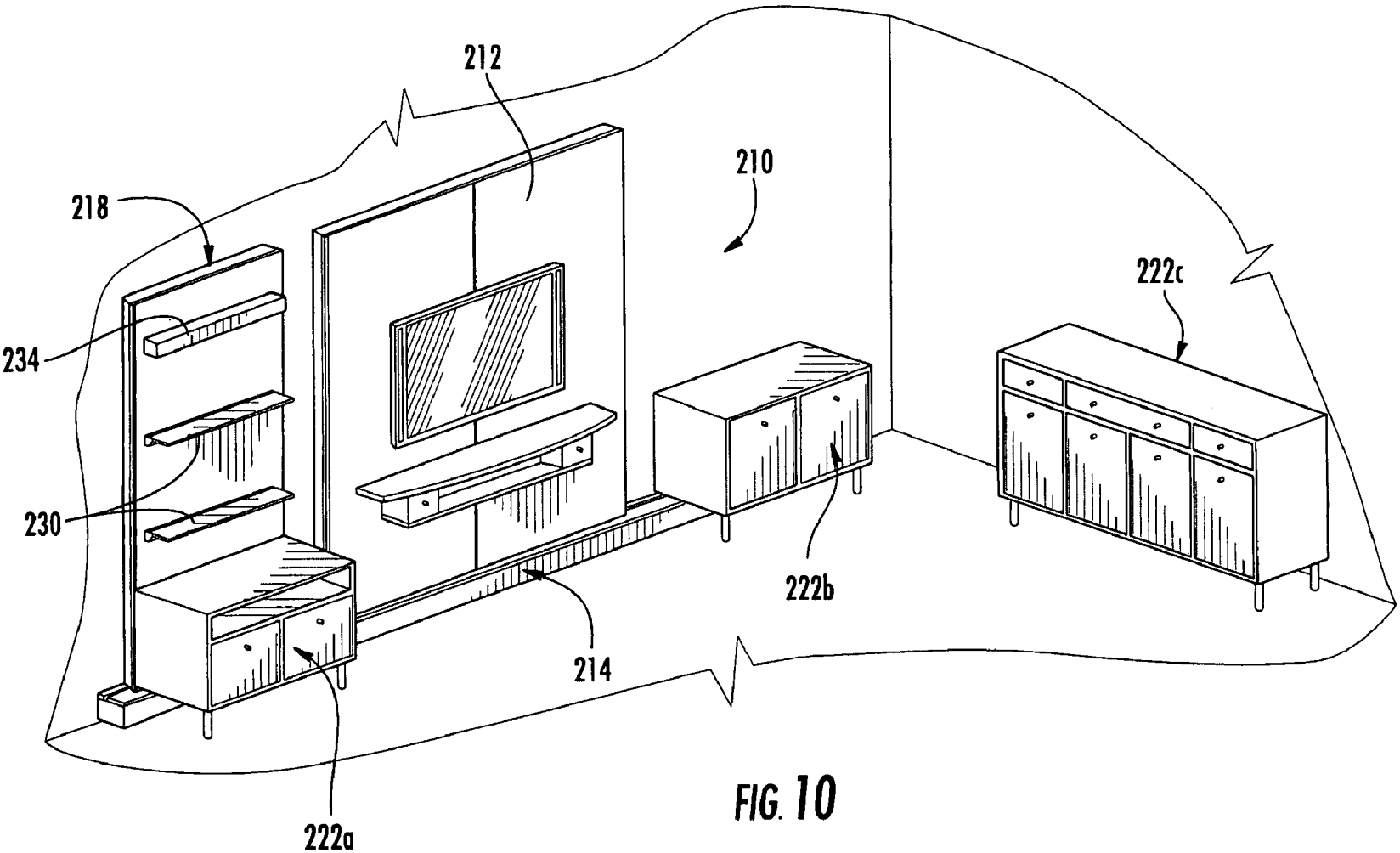
FIG. 10 is a perspective view of another media center of the present invention.

Optionally, and with reference to FIG. 10, a media center 210 may include a display panel 212 and a channel member 214, similar to those described above (such that a detailed discussion of these portions or members or components will not be repeated herein), a column 218 at one side of the display panel 212, with a cabinet 222*a* at the column 218, and another cabinet 222*b* at the other side of the display panel 212. A separate, free standing cabinet or housing 222*c* with similar design features as the cabinets 222*a*, 222*b* may be provided as a separate unit for more storage space or the like, if desired.

Column 218 may be substantially similar to column 118, described above, and may include one or more shelves 230 and may include a light source 234 for illuminating the shelves 230. The column 218 may otherwise be substantially similar to column 118, discussed above, such that a detailed discussion of the columns will not be repeated herein. Likewise, the cabinet 222*a* may be substantially similar to the cabinet 122*a* discussed above. In the illustrated embodiment, the column 218 and cabinet 222*a* are wider than the column 118 and cabinet 122*a*, discussed above, to provide additional storage and a different appearance and functionality to the media center 210.

Media center 210 also includes cabinet 222*b*, which is partially supported on and may be movably attached to the channel member 214, without a respective column or the like at the channel member. In such an application, the cabinet may be adjustably or movably attached to the support portion of the channel member, and may be moved relative to the channel member to facilitate access to the wires and cables at the cabinet 222*b*, such as via an adjustable mounting mechanism (not shown in FIG. 10) and such as in a similar manner as described above. For example, the cabinet 222*b* may be movable between a use position, where the rear portion of the cabinet is substantially abutted against or aligned with or in proximity to the channel member and/or wall, and an access or service position, where the rear portion of the cabinet is spaced from the channel member and wall. Optionally, another channel member or members (not shown in FIG. 10) may be positioned along the walls and abutted or interconnected together to facilitate wires and cables to be routed between the separate cabinet 222*c* (which may be movably attached to the other channel member in a similar manner as described above) and the channel member 214 and cabinets 222*a*, 222*b* and display panel 212 and column 218, if desired, without affecting the scope of the present invention.

Optionally, a media center 310 (FIG. 11) may include a channel member 314 and a cabinet 322 and a column 318. In the illustrated embodiment, the column 318 is substantially similar to the column 218 discussed above, but may be narrower and may not include an opening in the front wall (since there is no cabinet in front of the column 318). The cabinet or housing portion 322 of media center 310 may be movably mounted or attached to the channel member (such as in a similar manner as described above), and may support a video display device 316 (such as a television screen or the like) on an upper surface of the cabinet. The media center 310 thus may not include a main display panel for supporting the video display. Optionally, the media center 310 may include an accessory 316', such as an illumination source or a projection screen or the like, that is positioned generally above the cabinet and may be mounted to the wall against which the media center is positioned. If a projection screen is provided, the projection screen may be pulled down or otherwise lowered for projecting a video or image onto the screen via a projector or the like, and may be raised or retracted when not in use.

Figure 11:
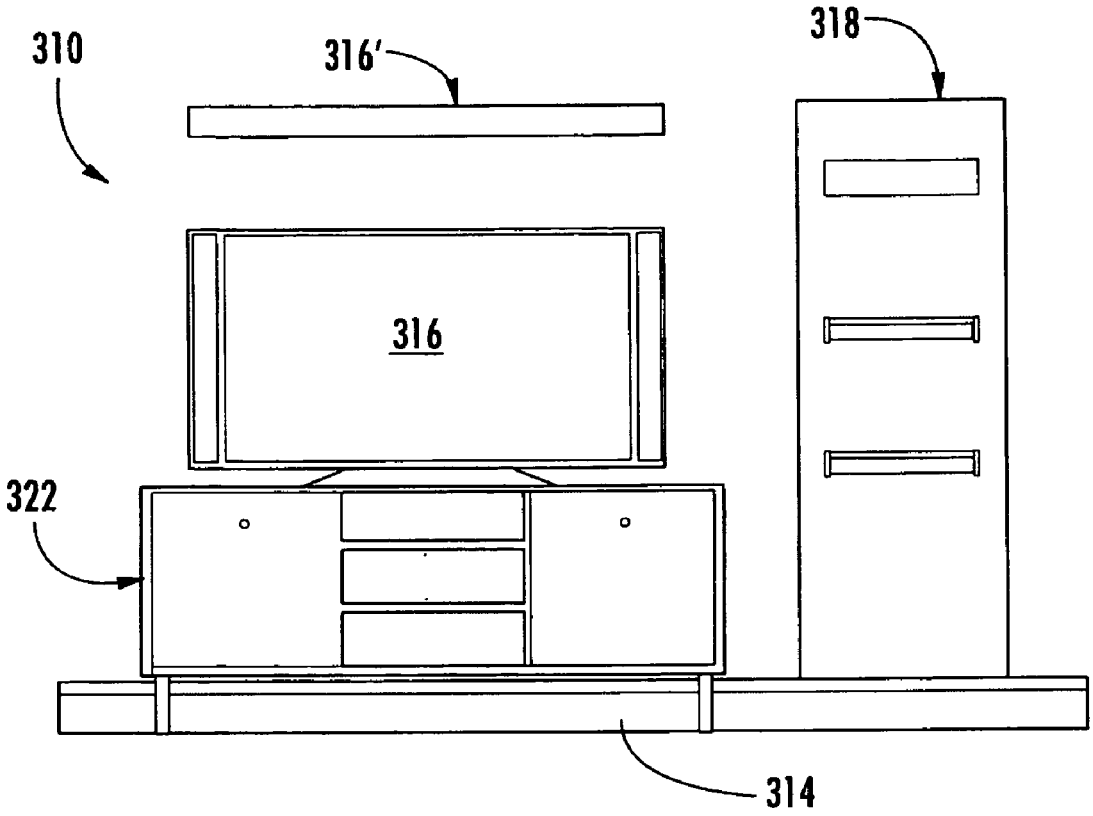
FIG. 11 is a front elevation of another media center of the present invention.
Figure 12:
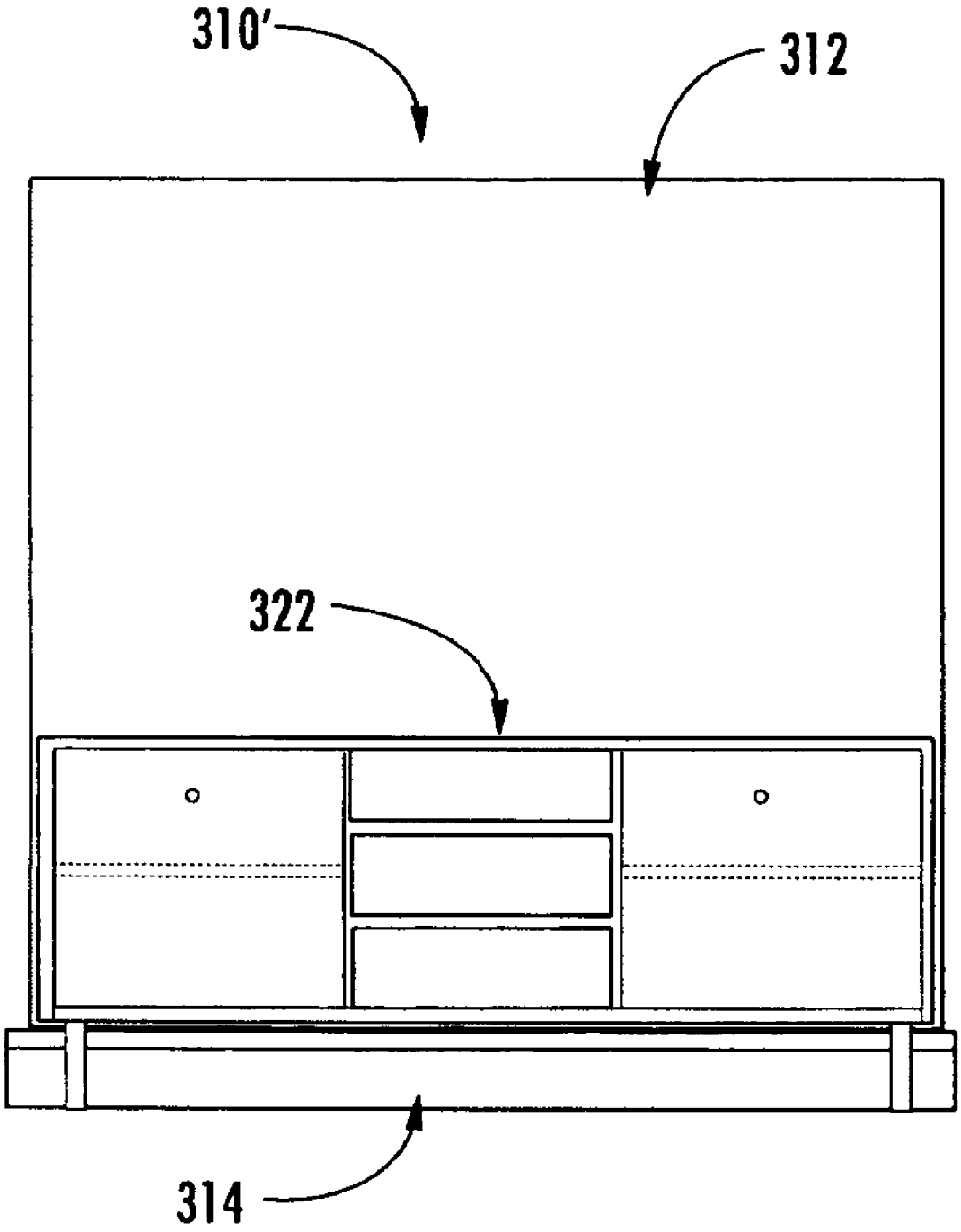
FIG. 12 is a front elevation of another media center of the present invention, with a single display panel and cabinet portion.
Figure 13:
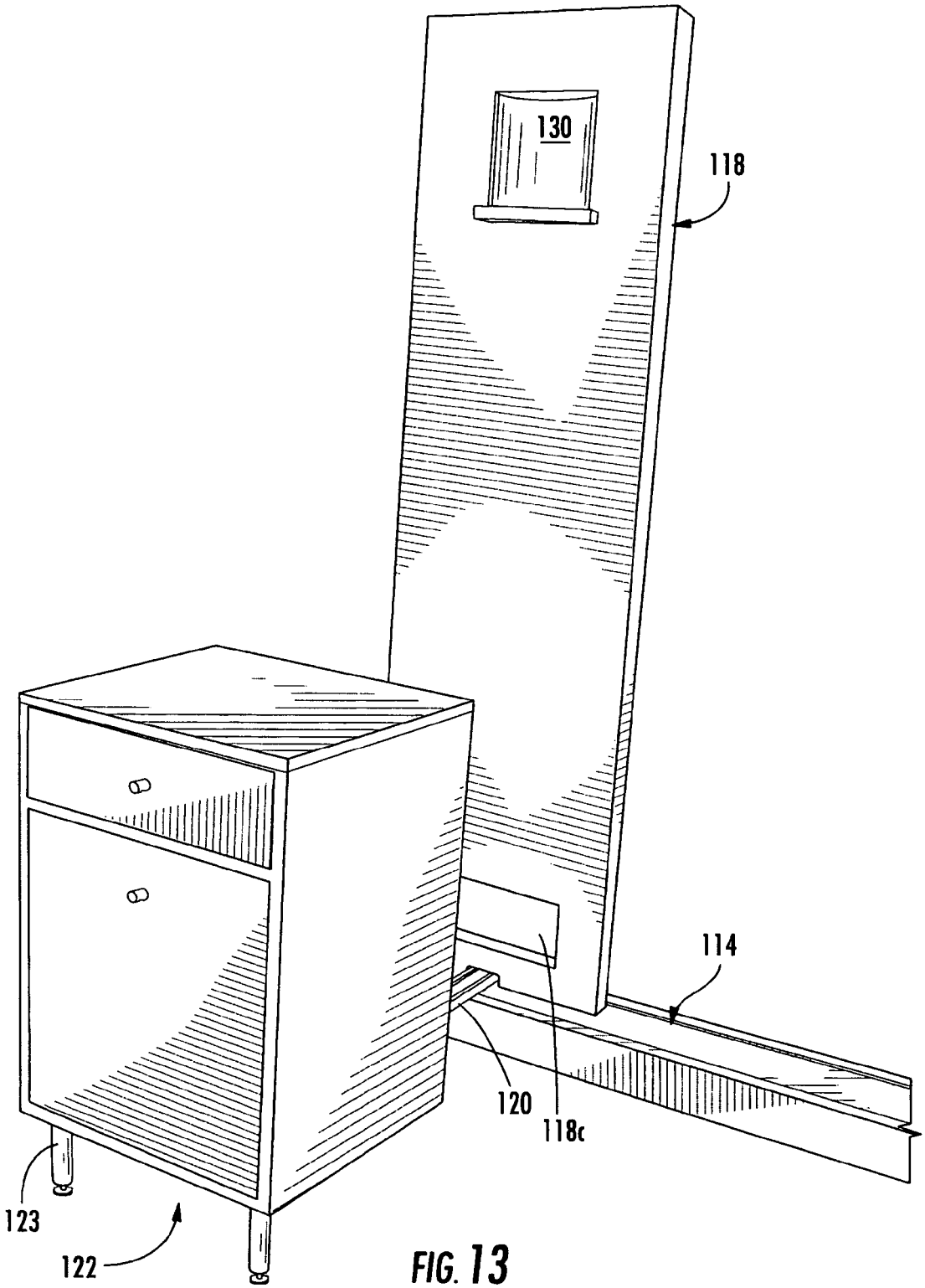
FIG. 13 is a perspective view of a media center of the present invention, with the cabinet portion moved outwardly from a display panel and channel member.

Optionally, a media center 310' (FIG. 12) may include a channel member 314, a main display panel 312 and a cabinet or housing portion 322. The cabinet may be sized to span substantially the entire length of the channel member 314, and may be movably mounted to or attached to the display panel 312 and/or the channel member 314, such as in a similar manner as described above. The display panel may not include or support a video display thereon, whereby the cabinet may support a display device (such as shown in FIG. 11), and/or an extendable/retractable screen may be mounted to an upper portion of the display panel and may be pulled down or otherwise lowered for projecting a video or image onto the screen via a projector or the like, and may be raised or retracted when not in use.

In each embodiment described above, one or more vertical column or panel is supported on a channel member and/or one or more cabinet is adjustably mounted to one or more column or channel member. The cabinet is movably mounted to the column or channel member so that the cabinet may be readily pulled or moved away from the column or wall for accessing the wires and cables and connections at the rear of the cabinet and at the interface of the cabinet and channel member or column. After the setup or servicing or changeover is completed, the cabinet may be readily moved back into the proper position and orientation with respect to the column or channel member, since the adjustment mechanism maintains or indexes the position and orientation of the cabinet relative to the column and/or channel member. The various embodiments described above are exemplary of the media center of the present invention, and the media center is not intended to be limited to those configurations. Other configurations and optional sizes and shapes and designs of various cabinets or credenzas and display panels or columns may be implemented, without affecting the scope of the present invention.

Preferably, the columns and/or panels and channel member are at least substantially supported on the floor or support surface (for example, the channel member may be supported on the floor, with the columns and/or panels supported on the channel member), such that no attachment fasteners or anchors are required to attach or hang the column/panel to or from the wall at which it is positioned. If any attachment to the wall of the room is desired, various fasteners (such as with z-brackets or the like) may optionally be implemented to retain the column and/or panel at or against or adjacent to the wall, so as to further stabilize the column and/or panel and limit tipping of the column and/or panel away from the wall, without affecting the scope of the present invention. The fasteners thus may stabilize the column/panel, but may function to support little or no weight of the columns/panel.

Accordingly, the media center of the present invention may include one or more channel members and/or one or more display panels/columns and/or one or more cabinets or housing portions, in various configurations and combinations, depending on the particular appearance and functionality of the media center. The channel members, display panels, columns and/or cabinets may be available in a variety of sizes and widths to provide the desired appearance and function. The channel member may be positioned along the floor of the room and along a wall of the room. The columns and display panels are supported on the channel member and are thus supported on the floor, and thus are not supported on the wall of the room. Installation of the media center is thus enhanced, since the columns and/or display panels are not mounted to or hung from the walls (however, one or more small anchors or fasteners, such as z-clips or the like, may be used to hold the upper ends of the columns or display panels to the wall for stability, if desired, without affecting the scope of the present invention). The columns and display panels thus may be arranged and located anywhere along the walls of the room without having to align with studs or the like in the walls, such that the media center of the present invention provides enhanced planning flexibility. Optionally, a variety of column-integrated or display panel-integrated components may be available, such as cabinets, pedestals, credenzas, shelves (such as for holding equipment, for display, for videoconferencing equipment, and the like), lighting fixtures, projection screens or other video displays or screens, marker boards, computer stations and the like, without affecting the scope of the present invention. The columns, display panels and channel member or members facilitate routing of the wires and cables of the various electronic components throughout the media center while concealing the wires and cables from view. The cabinet or cabinets is/are movably mounted to the channel member and/or to the column/panel so that the cabinet/cabinets may be readily pulled out or moved from the channel member/column/panel and pushed back or moved back into the appropriate or desired location at the channel member/column/panel. The media center of the present invention is thus well-suited for a variety of applications, including conference rooms, training rooms, private offices, reception and lounge areas, and even home or residential areas.

Changes and modifications to the specifically described embodiments may be carried out without departing from the principles of the present invention, which is intended to be limited only by the scope of the appended claims as interpreted according to the principles of patent law.

What is claimed is:

1. A media center for housing audio-video equipment and displaying a video display, said media center comprising:

a housing portion for housing at least one electronic component, said housing portion having a front portion and a rear portion and an upper surface, said housing portion defining a compartment for housing at least one electronic component, said upper surface being above said compartment, said housing portion being at least partially supported on a support surface;

a display panel, said display panel comprising a generally vertically oriented display wall and opposite side walls, said display wall and said opposite side walls defining a cavity for routing wires of the at least one electronic component, at least some of the wires of the at least one electronic component of said housing portion are routed from said housing portion into said cavity of said display panel, said display panel being at least partially supported on the support surface, said display wall of said display panel extending upwardly above said housing portion so as to be viewable above said upper surface of said housing portion when said housing portion is in a use position; and an attachment mechanism, said housing portion being movably attached to said display panel via said attachment mechanism, said housing portion being movable relative to said display panel between said use position, where said rear portion of said housing portion is substantially abutted against a lower portion of said display panel, and a service position, where said rear portion of said housing portion is at least partially spaced from said display panel for accessing wires of the at least one electronic component;

wherein said display panel includes a storage element that is generally horizontally movable between a retracted position, where said storage element is positioned within said cavity of said display panel, and an extended position, where said storage element is extended from said side wall of said display panel.

2. The media center of claim 1, wherein said attachment mechanism comprises a generally vertical pivot axis, said housing portion being pivotable about said pivot axis between said use position and said service position.

3. The media center of claim 2 including a wire routing portion for routing at least one wire from said housing portion to said cavity of said display panel, said wire routing portion being located at a side region of said housing portion near said pivot axis.

4. The media center of claim 3, wherein said display panel includes an aperture through said display wall below a level of said upper surface of said housing portion, said wire routing portion routing through said aperture and into said cavity of said display panel.

5. The media center of claim 1, wherein said housing portion includes a removable panel at said rear portion, said removable panel being removable from said housing portion when said housing portion is in said service position.

6. The media center of claim 1, wherein said storage element includes an outer cover that substantially matches and aligns with said side wall when said storage element is in said retracted position.

7. The media center of claim 1, wherein said display panel is substantially supported on the support surface and said housing portion is substantially supported on the support surface independent of said display panel.

8. The media center of claim 1, wherein said attachment mechanism comprises at least one track, said housing portion being movable along said track and generally toward and away from said display panel.

9. The media center of claim 1 including a channel member extending along the support surface of said media center, said channel member providing a conduit for routing wires therealong, said display panel being at least substantially supported on said channel member.

10. The media center of claim 9 including a generally vertically oriented panel supported on said channel member and spaced from said display panel, said channel member routing wires between said panel and said display panel.

11. A media center for housing audio-video equipment and displaying a video display, said media center comprising:

a cabinet portion for housing at least one electronic component, said cabinet portion having a front portion and a rear portion and an upper surface, said cabinet portion defining a compartment for housing at least one electronic component, said upper surface being above said compartment, said cabinet portion being at least substantially supported on a support surface;

a display panel at least substantially supported on the support surface, said display panel comprising a generally vertically oriented display wall and opposite side walls, said display wall of said display panel extending upwardly above said cabinet portion so that an upper portion of said display wall of said display panel is viewable above said cabinet portion when said cabinet portion is in a use position, said display wall and said opposite side walls defining a cavity, said display wall having an opening therethrough that is located below a level of said upper surface of said cabinet portion, said media center being configured to mount a video display screen at said upper portion of said display wall of said display panel, the wires of the video display screen being routed through said cavity and through said opening and into said cabinet portion; and a hinge portion having a generally vertical pivot axis, said cabinet portion being pivotally attached to said display panel via said hinge portion, said cabinet portion being pivotable relative to said display panel between said use position, where said rear portion of said cabinet portion is substantially abutted against said display wall of said display panel, and a service position, where said rear portion of said cabinet portion is at least partially spaced from said display wall for accessing wires of the video display and the at least one electronic component.

12. The media center of claim 11, wherein said cabinet portion includes a removable panel at said rear portion, said removable panel being removable from said cabinet portion when said cabinet portion is in said service position.

13. The media center of claim 11, wherein said display panel includes a storage element that is generally horizontally movable between a retracted position, where said storage element is positioned within said cavity of said display panel, and an extended position, where said storage element is extended from said side wall of said display panel.

14. A media center for housing audio-video equipment and displaying a video display, said media center comprising:

a channel member positioned along a support surface and defining a conduit therealong for routing wiring;

a cabinet portion at least partially supported by said channel member, wherein said cabinet portion supports at least one electronic accessory, said channel member being configured to route wires of the at least one accessory; and an adjustable mounting structure that adjustably mounts said cabinet portion relative to said channel member, said cabinet portion being movable relative to said channel member between a use position, where a rear portion of said cabinet portion is substantially abutted against or aligned with a portion of said channel member, and a service position, where said rear portion of said cabinet portion is at least partially spaced from said portion of said channel member for accessing the wires of the at least one electronic accessory; and a generally vertically oriented panel member at least partially supported by said channel member, said cabinet portion being adjustably mounted to said panel member via said adjustable mounting structure, wherein said channel member has a cover portion extending along said channel member that is movable relative to said support portion to access said conduit along substantially the entire length of said channel member.

15. The media center of claim 14, wherein said panel member is supported on a support portion of said channel member, said support portion being generally fixed when said channel member is positioned along the support surface.

16. The media center of claim 14, wherein said cover portion pivots about a generally horizontal pivot axis and away from said support portion to access said conduit.

17. The media center of claim 14, wherein said adjustable mounting structure comprises at least one track, said cabinet portion being movable along said at least one track between said use position and said service position.

18. The media center of claim 14, wherein said panel member comprising a display wall and opposite side walls, said display wall and said opposite side walls defining a cavity for routing wires of at least one electronic accessory.

19. A media center for housing audio-video equipment and displaying a video display, said media center comprising:

a channel member positioned along a support surface and defining a conduit therealong for routing wiring;

a cabinet portion at least partially supported by said channel member, wherein said cabinet portion supports at least one electronic accessory, said channel member being configured to route wires of the at least one accessory; and an adjustable mounting structure that adjustably mounts said cabinet portion relative to said channel member, said cabinet portion being movable relative to said channel member between a use position, where a rear portion of said cabinet portion is substantially abutted against or aligned with a portion of said channel member, and a service position, where said rear portion of said cabinet portion is at least partially spaced from said portion of said channel member for accessing the wires of the at least one electronic accessory;

a generally vertically oriented panel member at least partially supported by said channel member, said cabinet portion being adjustably mounted to said panel member via said adjustable mounting structure, said panel member at least partially supported on said channel member, said panel member comprising a display wall and opposite side walls, said display wall and said opposite side walls defining a cavity for routing wires of at least one electronic accessory; and a second panel member, said rear portion of said cabinet portion being substantially abutted against said second panel member in said use position and said rear portion of said cabinet portion being at least partially spaced from said second panel member in said service position.

20. The media center of claim 19, wherein said adjustable mounting structure comprises at least one track extending from said second panel member, said cabinet portion being movable along said at least one track between said use and service positions.

* * * * *